US012768096B2

(12) United States Patent
Lee et al.

(10) Patent No.: US 12,768,096 B2
(45) Date of Patent: Oct. 20, 2026

(54) INTEGRATED WASHING-DRYING MACHINE AND METHOD FOR CONTROLLING THE SAME

(71) Applicant: LG Electronics Inc., Seoul (KR)

(72) Inventors: Dongsoo Lee, Seoul (KR); Hyemin Kang, Seoul (KR); Taewoong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1110 days.

(21) Appl. No.: 17/770,863

(22) PCT Filed: Oct. 7, 2020

(86) PCT No.: PCT/KR2020/013656
§ 371 (c)(1),
(2) Date: Apr. 21, 2022

(87) PCT Pub. No.: WO2021/080218
PCT Pub. Date: Apr. 29, 2021

(65) Prior Publication Data

US 2022/0396911 A1 Dec. 15, 2022

(30) Foreign Application Priority Data

Oct. 21, 2019 (KR) ..... 10-2019-0130870

(51) Int. Cl.
*D06F 58/45* (2020.01)
*D06F 29/00* (2006.01)
(Continued)

(52) U.S. Cl.
CPC ..... *D06F 58/45* (2020.02); *D06F 29/005* (2013.01); *D06F 33/69* (2020.02); *D06F 58/206* (2013.01);
(Continued)

(58) Field of Classification Search
CPC ..... D06F 29/005; D06F 33/69; D06F 58/206; D06F 58/24; D06F 58/45
See application file for complete search history.

(56) References Cited

U.S. PATENT DOCUMENTS

2010/0101606 A1 4/2010 Grunert
2012/0024801 A1 2/2012 Grunert et al.
2019/0284749 A1* 9/2019 Dunn ..... D06F 58/24

FOREIGN PATENT DOCUMENTS

CN 101652514 2/2010
CN 106854825 6/2017
(Continued)

OTHER PUBLICATIONS

KR101186159—Machine Translation (Year: 2012).*
(Continued)

*Primary Examiner* — Joseph L. Perrin
(74) *Attorney, Agent, or Firm* — Fish & Richardson P.C.

(57) ABSTRACT

A washing-drying machine includes a housing, a drying drum disposed at an upper side in the housing and configured to accommodate laundry to be dried, a washing drum disposed at a lower side in the housing and configured to accommodate laundry to be washed, a heat pump including an evaporator, a compressor, and a condenser and being configured to produce hot air and to supply the hot air to the drying drum, and a cleaner configured to clean the condenser by spraying cleaning water to the condenser. The cleaning water includes at least any one of condensate water condensed from the evaporator or washing water to be supplied to the washing drum. The washing-drying machine performs a method that includes supplying the washing water to clean the condenser based on an amount of the condensate water being insufficient to clean the condenser.

10 Claims, 8 Drawing Sheets

(51) Int. Cl.

| | |
|---|---|
| ***D06F 33/69*** | (2020.01) |
| ***D06F 58/20*** | (2006.01) |
| ***D06F 58/24*** | (2006.01) |
| *D06F 101/20* | (2020.01) |
| *D06F 103/58* | (2020.01) |
| *D06F 105/02* | (2020.01) |
| *D06F 105/54* | (2020.01) |

(52) U.S. Cl.
CPC ..... *D06F 58/24* (2013.01); *D06F 2101/20* (2020.02); *D06F 2103/58* (2020.02); *D06F 2105/02* (2020.02); *D06F 2105/54* (2020.02)

(56) References Cited

FOREIGN PATENT DOCUMENTS

| | | | | |
|---|---|---|---|---|
| CN | 110055709 | | 7/2019 | |
| CN | 110055710 | | 7/2019 | |
| DE | 102006018469 | A1 | 10/2007 | |
| DE | 102007016074 | | 10/2008 | |
| EP | 2796614 | A1 * | 10/2014 | ..... D06F 58/30 |
| EP | 2796615 | A1 | 10/2014 | |
| EP | 3686334 | A1 * | 7/2020 | ..... D06F 29/005 |
| KR | 20110059993 | | 6/2011 | |
| KR | 20110123344 | | 11/2011 | |
| KR | 101186159 | | 10/2012 | |
| KR | 101186159 | B1 * | 10/2012 | |
| KR | 101410595 | | 6/2014 | |
| WO | WO 2013/094145 | | 6/2013 | |
| WO | WO 2019/052345 | | 3/2019 | |

OTHER PUBLICATIONS

Office Action in Chinese Appln. No. 202080073854.6, mailed on Apr. 24, 2023, 14 pages (with English translation).
Office Action in Australian Appln. No. 2020372167, mailed on Aug. 13, 2024, 6 pages.
Extended European Search Report in European Appln. No. 20879395.0, mailed on Oct. 16, 2023, 3 pages.
International Search Report in International Appln. No. PCT/KR2020/013656, dated Jan. 15, 2021, 6 pages (with English translation).

* cited by examiner

INTEGRATED WASHING-DRYING MACHINE AND METHOD FOR CONTROLLING THE SAME

CROSS-REFERENCE TO RELATED APPLICATIONS

This application is a National Stage application under 35 U.S.C. § 371 of International Application No. PCT/KR2020/013656, filed on Oct. 7, 2020, which claims the benefit of Korean Application No. 10-2019-0130870, filed on Oct. 21, 2019. The disclosures of the prior applications are incorporated by reference in their entirety.

TECHNICAL FIELD

The present disclosure relates to a laundry machine and a method for controlling the same, and more particularly, to a washing-drying machine including a drying drum and a washing drum that are disposed in a single housing, where the washing-drying machine is configured to use washing water or condensate water to clean a condenser, and a method for controlling the same.

BACKGROUND

A front-loading washing machine may have a smaller size but a larger washing capacity than a top-loading washing machine. In some cases, the front-loading washing machine may have a high washing performance and may not cause a tangle of laundry.

In some cases, the front-loading drying machine may be configured to receive washed laundry into the front-loading type drying machine through a front portion of the front-loading type drying machine. In some cases, the drying machine may have similar advantages as the front-loading type washing machine.

Many homes and laundry facilities may use the washing machine and the drying machine together. For example, the washing machine and the drying machine can be used while being disposed side by side in a lateral direction. In some cases, the washing machine and the drying machine may occupy a large area. Thus, in some cases, as illustrated in FIG. 1, a drying machine D is stacked on a washing machine W to minimize an installation area.

In some cases, it may be difficult to install the washing machine and the drying machine in the interior space with a low height. Therefore, in some cases, the washing machine and the drying machine may be integrated to reduce a total installation height.

In some examples, the drying machine may include a heat pump to produce a hot air to reduce energy consumption.

For example, high-temperature air discharged from a drying drum may be cooled and condensed while exchanging heat with an evaporator, and the hot air may be produced while air to be supplied to the drying drum exchanges heat with a condenser. The use of the heat pump can allow the amount of heat, which was discarded during the discharging and condensing process, to be used to produce the hot air, which makes it possible to reduce energy consumption to that extent.

In some cases, the air, which passes through the evaporator and the condenser as described above, may come into contact with clothes, which are drying targets, and then be discharged. For this reason, the air may contain a large amount of lint separated from surfaces of the clothes during the drying process. To remove the lint, a lint removing filter may be installed in a discharge flow path for the hot air and disposed at a position before the hot air is introduced into the evaporator. The lint removing filter may prevent or reduce, to some extent, the lint from being discharged to the outside or introduced into the evaporator.

In some examples, the lint removing filter may have small meshes to improve the performance in removing the lint. In some cases, resistance of a flow path may increase, and discharge efficiency may deteriorate, which results in a limitation in reducing sizes of the meshes.

In some cases, some of the lint may be introduced into the heat pump while passing through the lint removing filter, and the introduced lint is attached to a surface of the condenser, which causes deterioration in heat exchange efficiency and increases air flow resistance.

Various attempts have been made to remove the lint accumulated on the surface of the condenser. For example, a drying machine may spray condensate water produced in the evaporator to a surface of a condenser to remove lint. In some cases, where the amount of condensate water is not sufficiently supplied, the lint may not be removed with the amount of available condensate water.

SUMMARY

The present disclosure describes an integrated washing-drying machine that includes a drying drum and a washing drum that are disposed in a single housing to minimize a height of a product. The integrated washing-drying machine includes components to perform a method to use washing water to be supplied to the washing drum to clean a condenser when an amount of condensate water is insufficient to clean the condenser.

According to one aspect of the subject matter described in this application, a washing-drying machine includes a housing, a drying drum disposed in a first portion of the housing and configured to accommodate laundry to be dried, a washing drum disposed in a second portion of the housing and configured to accommodate laundry to be washed, a heat pump comprising an evaporator, a compressor, and a condenser, the heat pump being configured to produce hot air and to supply the hot air to the drying drum, and a cleaner configured to spray cleaning water to the condenser to thereby clean the condenser, the cleaning water including at least one of condensate water condensed from the evaporator or washing water to be supplied to the washing drum.

Implementations according to this aspect can include one or more of the following features. For example, the washing-drying machine can further include a washing machine water supply connected to an external water supply source and configured to receive the washing water from the external water supply source. The cleaner can include a cleaning nozzle configured to spray the cleaning water to the condenser, a condensate water storage tank configured to store the condensate water condensed from the evaporator, a pump configured to supply the condensate water stored in the condensate water storage tank to the cleaning nozzle, a washing water supply flow path branched from the washing machine water supply and connected to the cleaning nozzle, the washing water supply flow path being configured to guide the washing water to the cleaning nozzle, and a washing water supply valve configured to open and close the washing water supply flow path. The washing-drying machine can further include a controller configured to control the pump and the washing water supply valve to thereby provide at least one of the condensate water or the washing water to the cleaning nozzle.

In some implementations, the cleaner can further include a water level sensor configured to measure a water level of the condensate water stored in the condensate water storage tank, where the controller can be configured to receive data from the water level sensor and to open the washing water supply valve based on the water level of the condensate water being less than or equal to a predetermined water level. In some examples, the controller can be configured to determine a supply amount of the condensate water stored in the condensate water storage tank and available to be supplied to the cleaner based on the water level of the condensate water in the condensate water storage tank, determine a supply amount of the washing water based on subtracting the supply amount of the condensate water from a target amount of the cleaning water to be supplied to the cleaning nozzle, and adjust an opening degree of the washing water supply valve to supply the supply amount of the washing water.

In some implementations, the cleaner can further include a washing drum discharge flow path that connects the heat pump to the washing drum and is configured to guide, to the washing drum, the cleaning water having been used to clean the condenser.

In some implementations, the washing-drying machine can include a discharge port connected to the washing drum and configured to discharge the washing water from the washing drum to an outside of the housing, where the cleaner can further include a discharge port discharge flow path that connects the washing drum discharge flow path to the discharge port and is configured to guide, to the discharge port, the cleaning water having been used to clean the condenser, and a cleaning water discharge valve disposed between the washing drum discharge flow path and the discharge port discharge flow path and configured to open and close each of the washing drum discharge flow path and the discharge port discharge flow path. The controller can be configured to control the cleaning water discharge valve to discharge, to the washing drum or the discharge port, the cleaning water having been used to clean the condenser.

In some implementations, the washing-drying machine can include a discharge port connected to the washing drum and configured to discharge the washing water from the washing drum to an outside of the housing, where the cleaner can include a discharge port discharge flow path that connects the heat pump to the discharge port and is configured to guide, to the discharge port, the cleaning water having been used to clean the condenser. In some examples, the cleaner can further include a cleaning nozzle configured to spray the cleaning water to the condenser. In some examples, the washing-drying machine can include a controller configured to determine whether a condenser cleaning command is inputted, based on the condenser cleaning command being inputted, determine whether a drying function of the drying drum is performed, and based on determining that the drying function is not performed, clean the condenser by supplying the cleaning water to the cleaning nozzle.

In some implementations, the first portion of the housing can be an upper space in the housing, and the second portion of the housing can be a lower space in the housing. In some examples, the condenser can be disposed in the second portion of the housing, and the cleaner can be disposed between the drying drum and the condenser. In some implementations, the washing-drying machine can include a washing machine water supply connected to an external water supply source and configured to receive the washing water from the external water supply source and to supply the washing water to one of the washing drum or the cleaner.

According to another aspect, a method controls a washing-drying machine including a housing, a drying drum disposed in a first portion of the housing, a washing drum disposed in a second portion of the housing, and a cleaner configured to spray cleaning water through a cleaning nozzle to clean a condenser. The method includes determining whether a condenser cleaning command is inputted, based on the condenser cleaning command being inputted, determining whether a drying function of the drying drum is performed, and based on determining that the drying function is not performed, cleaning the condenser by supplying the cleaning water to the cleaning nozzle, where the cleaning water includes at least one of condensate water stored in a condensate water storage tank or washing water to be supplied to the washing drum.

Implementations according to this aspect can include one or more of the following features. For example, the condenser cleaning command can include any one or a combination of two or more inputs among a plurality of inputs, the plurality of inputs comprising an automatic input provided at a regular interval, an input received from a user before the drying function is performed, and an input received from the user after the drying function is completed. In some examples, cleaning the condenser can include supplying the condensate water to the cleaning nozzle, measuring a water level of the condensate water stored in the condensate water storage tank, and supplying the washing water based in the water level of the condensate water being less than or equal to a predetermined water level.

In some implementations, cleaning the condenser can include measuring a water level of the condensate water stored in the condensate water storage tank, determining a supply amount of the condensate water stored in the condensate water storage tank and available to be supplied to the cleaner based on the water level of the condensate water in the condensate water storage tank, determining a supply amount of the washing water based on subtracting the supply amount of the condensate water from a target amount of the cleaning water to be supplied to the cleaning nozzle, supplying the supply amount of the condensate water to the cleaning nozzle, and supplying the supply amount of the washing water to the cleaning nozzle.

In some implementations, the method can include discharging the cleaning water having been used to clean the condenser to any one of the washing drum or a discharge port, where the discharge port is connected to the washing drum and configured to discharge the washing water from the washing drum to an outside of the housing. In some examples, the method can include determining whether a washing function of the washing drum is performed, where discharging the cleaning water can include, based on determining that the washing function is performed, discharging the cleaning water having been used to clean the condenser to the washing drum.

In some implementations, the method can include determining that the washing function is performed based on the washing water being supplied to the washing drum. In some examples, discharging the cleaning water can include, based on determining that the washing function is performed, discharging the cleaning water to the discharge port for a predetermined period of time and then discharging the cleaning water to the washing drum.

DETAILED DESCRIPTION

Hereinafter, an integrated washing-drying machine and a method for controlling the same will be described in more detail to assist in understanding features of the present disclosure.

Figure 1:
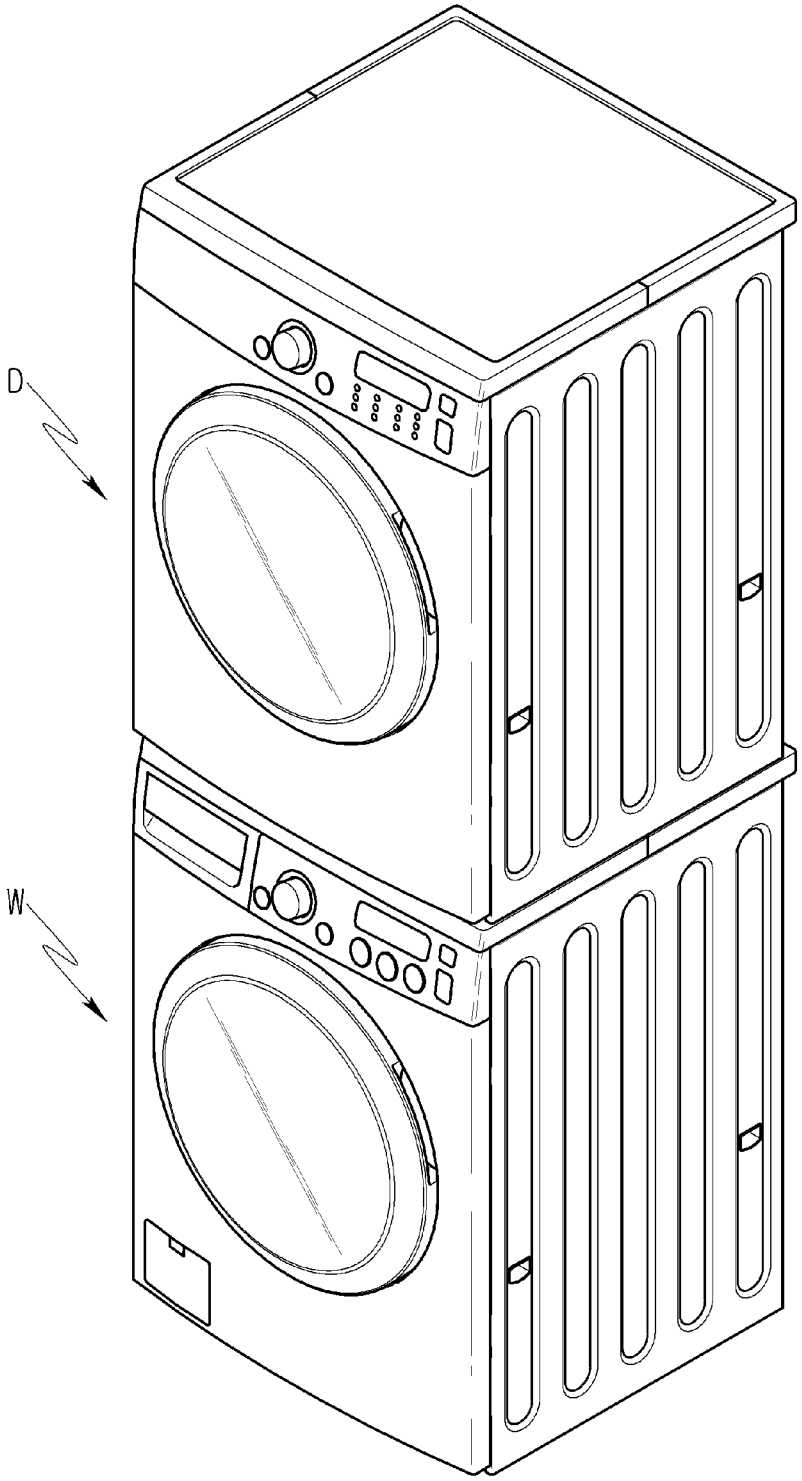
FIG. 1 RELATED ART
FIG. 1 is a perspective view schematically illustrating an example of a washing machine and a drying machine that are used in the related art.
Figure 2:
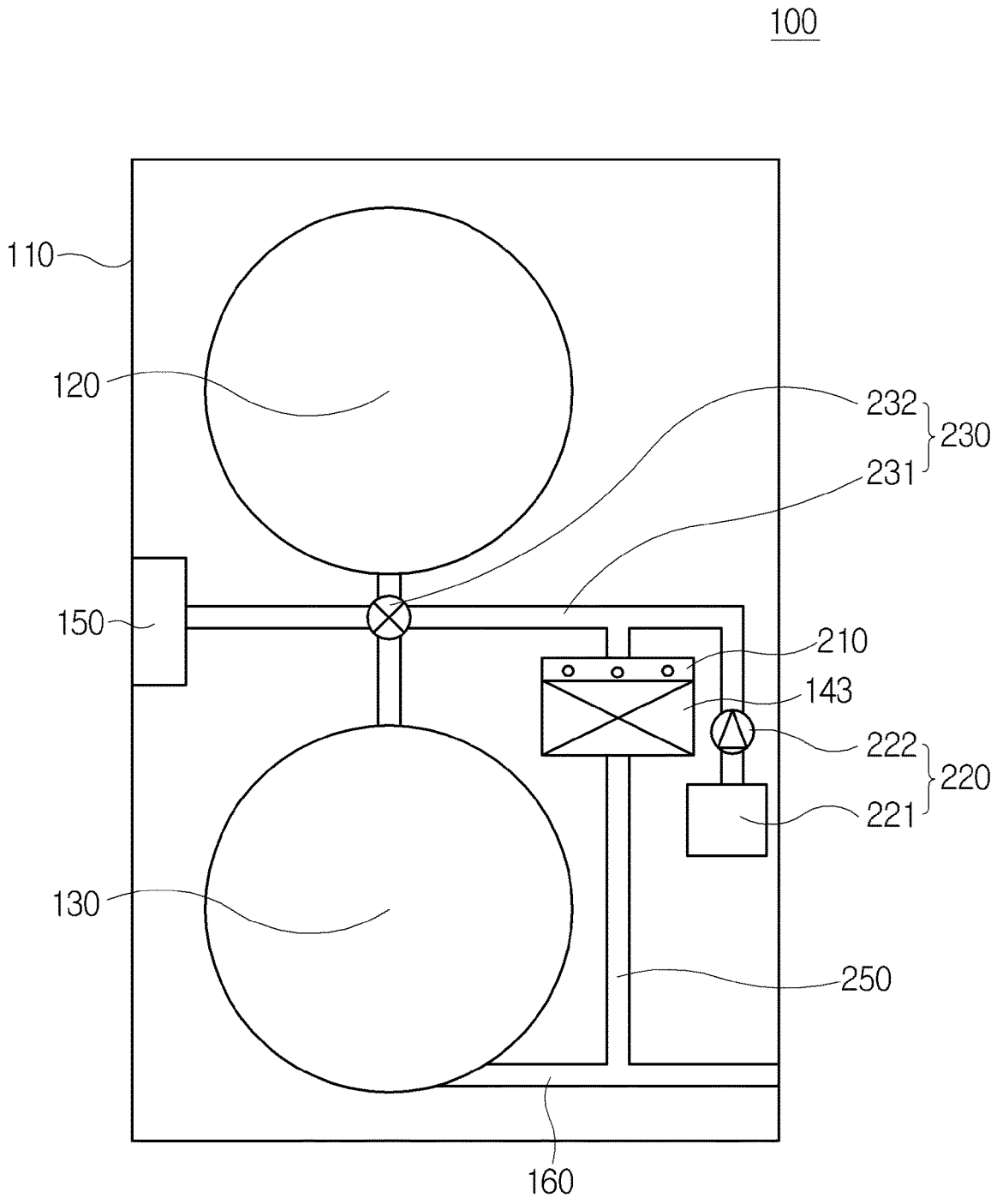
FIG. 2 is a view schematically illustrating an example of an integrated washing-drying machine according to an implementation of the present disclosure.
Figure 3:
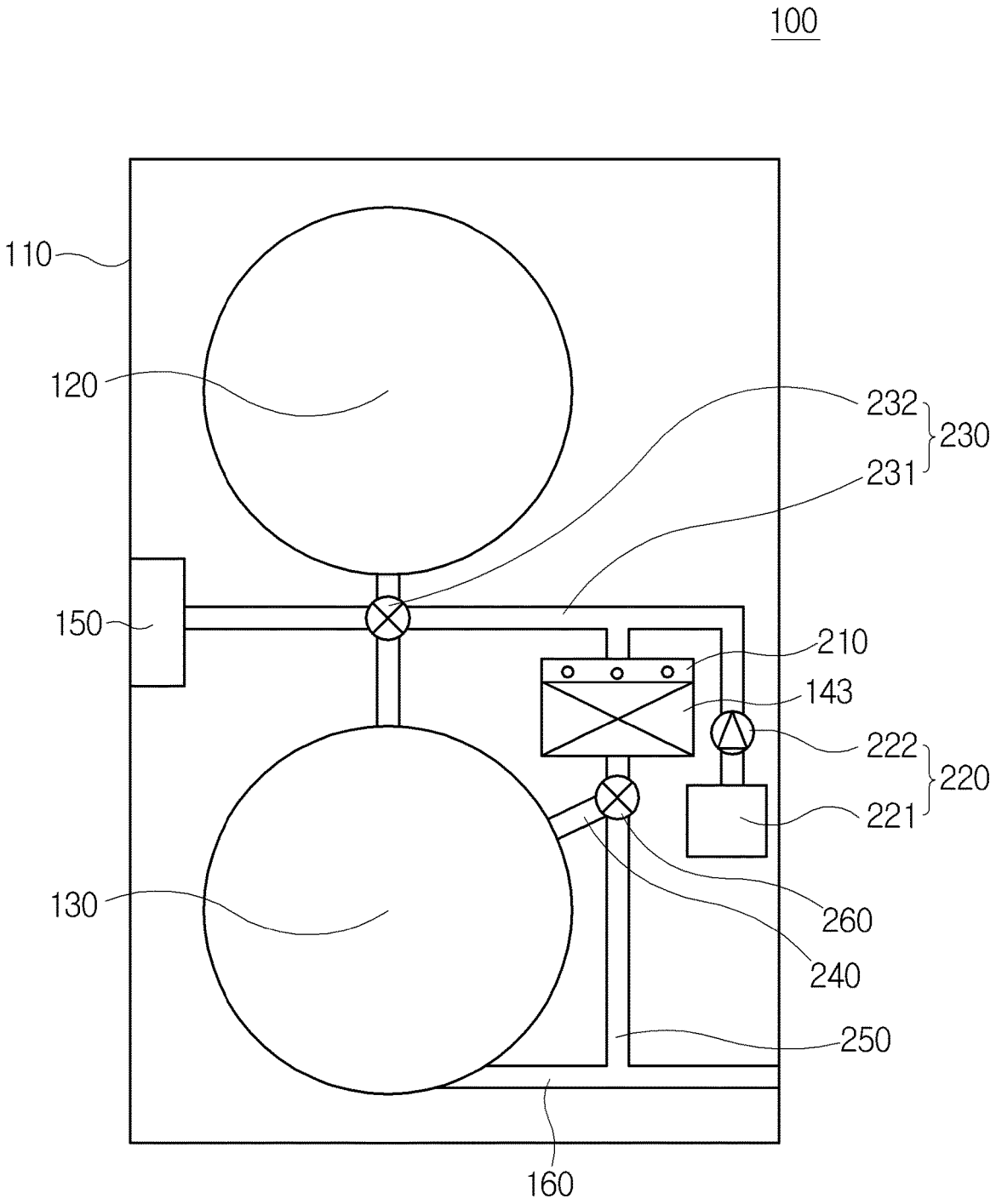
FIG. 3 is a view schematically illustrating an example of the integrated washing-drying machine in which cleaning water is supplied to a washing drum and reused.
Figure 4:
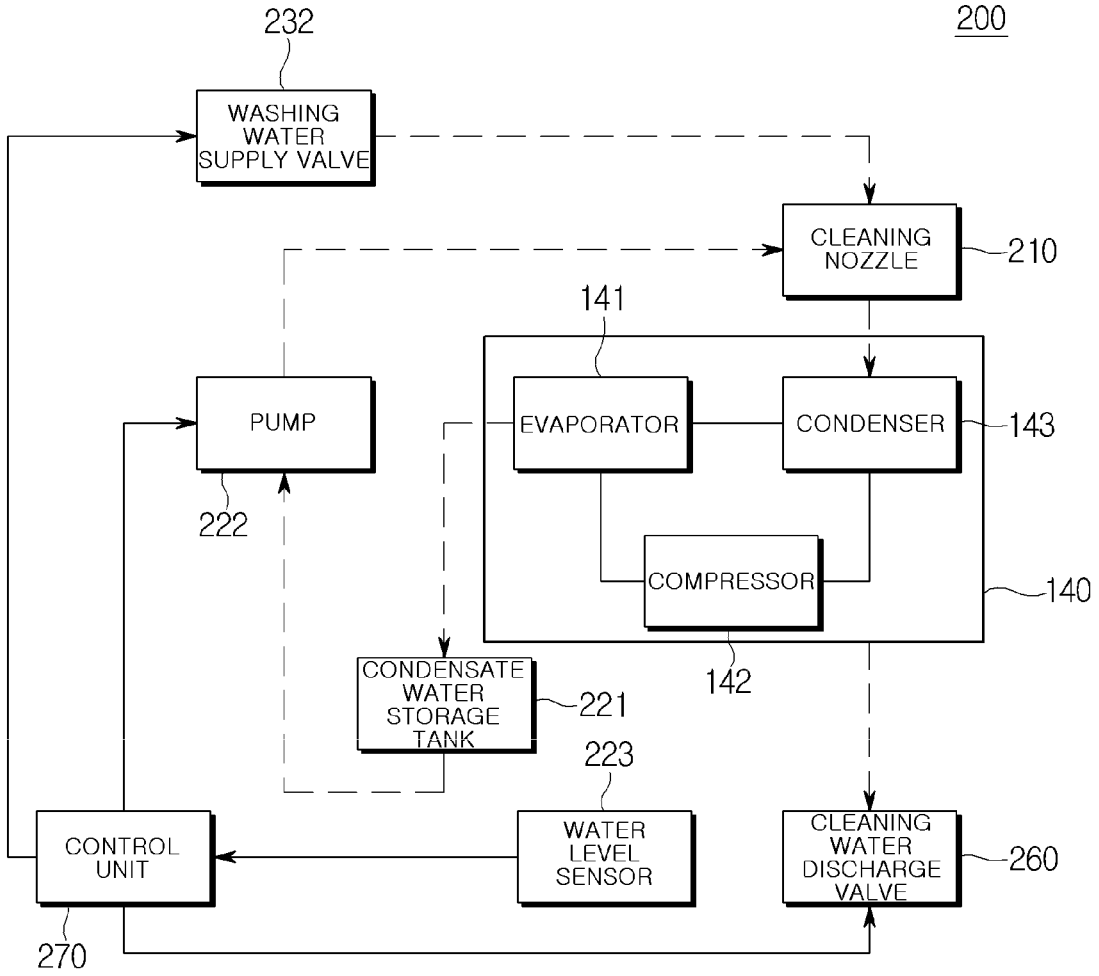
FIG. 4 is a block diagram schematically illustrating an example of a cleaner of the integrated washing-drying machine.

FIG. 2 is a view schematically illustrating an example of an integrated washing-drying machine, FIG. 3 is a view schematically illustrating an example structure of the integrated washing-drying machine in which cleaning water is supplied to a washing drum and reused, and FIG. 4 is a block diagram schematically illustrating an example of a cleaner of the integrated washing-drying machine.

In some implementations, referring to FIGS. 2 to 4, an integrated washing-drying machine 100 includes a housing 110, a drying drum 120 disposed at an upper side in the housing 110 and configured to accommodate and dry laundry, a washing drum 130 disposed at a lower side in the housing 110 and configured to accommodate and wash laundry, a heat pump 140 including an evaporator 141, a compressor 142, and a condenser 143 and configured to produce hot air and supply the hot air to the drying drum 120 to dry the laundry, and a cleaner 200 configured to clean the condenser 143 by spraying cleaning water to the condenser 143.

In some examples, the cleaner 200 can be configured to clean the condenser 143 by using, as the cleaning water, at least any one of condensate water produced in the evaporator 141 or washing water to be supplied to the washing drum 130, or both.

The housing 110 can have a quadrangular box shape that has a hollow portion therein. The drying drum 120, the washing drum 130, and the heat pump 140 can be disposed in the housing 110.

The washing drum 130 is disposed at the lower side in the housing 110 and washes the laundry according to a washing function when the laundry is loaded into the washing drum 130. Because the specific configuration and method for washing the laundry in the washing drum 130 are publicly-known technologies, a detailed description thereof will be omitted.

The drying drum 120 is disposed in the housing 110 and provided above the washing drum 130. The drying drum 120 dries the laundry according to a drying function when the laundry is loaded into the drying drum 120. That is, the heat pump 140 is disposed in the housing 110, hot air produced by the heat pump 140 is supplied to the drying drum 120, and the drying drum 120 rotates and dries the laundry loaded into the drying drum 120.

In some implementations, the drying drum 120 and the washing drum 13 can be disposed in a height direction in the single housing 110, and various components may be disposed in the single housing 110, which makes it possible to reduce a height in comparison with a structure in which a washing machine and a drying machine are separately stacked.

In the heat pump 140, the evaporator 141, the compressor 142, and the condenser 143 are connected by a refrigerant tube, and a refrigerant circulates. Air, which is heated through heat exchange between the refrigerant and the air in the condenser 143 and the evaporator 141, is supplied to the drums.

In some implementations, the evaporator 141 recover the amount of heat of the introduced air by allowing the air introduced after drying the laundry in the drying drum 120 to exchange heat with the refrigerant. In addition, the evaporator 141 condenses moisture contained in the introduced air. Therefore, the middle-temperature humid air introduced into the evaporator 141 is converted into low-temperature dry air by heat exchange with the evaporator 141, and the low-temperature dry air is introduced into the condenser 143.

The condenser 143 heats the air by allowing the low-temperature dry air passing through the evaporator 141 to exchange heat with the refrigerant. Therefore, the low-temperature dry air passing through the evaporator 141 is converted into high-temperature dry air while passing through the condenser 143. The high-temperature dry air is inputted into the drying drum 120 again and used to dry the laundry.

The compressor 142 compresses the evaporated refrigerant, which is evaporated while passing through the evaporator 141, and supplies the refrigerant to the condenser 143. That is, the high-temperature, high-pressure refrigerant compressed by the compressor 142 is condensed while passing through the condenser 143 and exchanging heat with the low-temperature air. Further, the refrigerant is evaporated while passing through the evaporator 141 and exchanging heat with the middle-temperature air and introduced into and compressed by the compressor 142.

In some implementations, the heat pump 140 can include a circulation fan configured to force the air to flow and circulate through the drying drum 120, the evaporator 141, and the condenser 143.

The cleaner 200 is configured to use, as the cleaning water for cleaning the condenser 143, at least any one of the condensate water produced in the evaporator 141 and the washing water to be supplied to the washing drum 130.

More specifically, the cleaner 200 includes a cleaning nozzle 210 configured to spray the cleaning water to the condenser, a condensate water supply unit 220 configured to supply the condensate water to the cleaning nozzle 210, a washing water supply unit 230 configured to supply the washing water to the cleaning nozzle 210, and a controller 270 (control unit) configured to perform control to supply at least any one of the condensate water and the washing water to the cleaning nozzle 210. For example, the controller 270 can include a processor or an electric circuit.

The cleaning nozzle 210 is disposed above the condenser 143 and serves to remove lint accumulated on the condenser 143 by spraying the cleaning water to a surface of a front end of the condenser 143. Because the specific configuration of the cleaning nozzle 210 configured to clean the condenser 143 by spraying the cleaning water is a publicly-known technology, a detailed structure thereof will be omitted.

The condensate water supply unit 220 includes a condensate water storage tank 221 configured to store the condensate water produced in the evaporator 141, and a pump 222 configured to supply the condensate water stored in the condensate water storage tank 221 to the cleaning nozzle 210.

The washing water supply unit 230 includes a washing water supply flow path 231 branching off from a washing machine water supply unit 150, connected to the cleaning nozzle 210, and configured to supply the washing water, and a washing water supply valve 232 configured to open or close the washing water supply flow path 231.

The washing machine water supply unit 150 is connected to an external water supply source such as water mains and supplied with water from the external water supply source. Further, the washing machine water supply unit 150 and the washing drum 130 can be connected by a flow path, and the washing machine water supply unit 150 can supply the washing water when the washing drum 130 performs the washing function.

In some implementations, the washing water supply flow path 231 branches off from the flow path that connects the washing machine water supply unit 150 and the washing drum 130, and the washing water supply valve 232 is disposed at a position at which the washing water supply flow path 231 branches off from the flow path.

That is, in a state in which the external water supply source consistently supplies water and the washing water supply valve 232 closes the flow path, the flow path can be opened to supply the washing water to the washing drum 130 in a case in which the washing drum 130 performs the washing function. Further, the washing water supply flow path 231 can be opened to supply the washing water to the cleaning nozzle 210 in a case in which the cleaner 200 cleans the condenser.

In some examples, the washing water supply valve 232 can be configured as a valve capable of opening any one or both of the washing water supply flow path 231 and the flow path connected to the washing drum 130 or closing both of the washing water supply flow path 231 and the flow path connected to the washing drum 130.

In some implementations, the washing machine water supply unit 150 can also have a separate valve, such that the washing machine water supply unit 150 can also allow or cut off the supply of the water from the external water supply source.

The controller 270 controls the pump 222 and the washing water supply valve 232 so that at least any one of the condensate water and the washing water is supplied to the cleaning nozzle 210 and used as the cleaning water. That is, the controller 270 can operate only the pump 222 and use only the condensate water as the cleaning water. The controller 270 can open the washing water supply valve 232 and use only the washing water as the cleaning water. The controller 270 can operate the pump 222 and open the washing water supply valve 232 to use both the condensate water and the washing water as the cleaning water.

Further, the condensate water supply unit 220 can further include a water level sensor 223 configured to measure a water level of the condensate water stored in the condensate water storage tank 221.

In the case in which the water level sensor 223 is further provided, the controller 270 receives data from the water level sensor 223 and performs control to open the washing water supply valve 232 when the controller 270 determines that the water level of the condensate water is equal to or lower than a predetermined water level. That is, when the controller determines that the amount of condensate water stored in the condensate water storage tank 221 is not sufficient to clean the condenser 143, the controller performs control to open the washing water supply valve 232 and supply the washing water to the cleaning nozzle 210, thereby supplying the sufficient amount of cleaning water.

In some implementations, when the controller 270 determines that the amount of condensate water stored in the condensate water storage tank 221 is small and thus may not be used as the cleaning water, the controller can perform control to supply the washing water from an initial cleaning step.

For example, based on the water level of the condensate water, the controller 270 can calculate the amount of supply condensate water that can be stored in the condensate water storage tank 221 and supplied, and the controller 270 can adjust an opening degree of the washing water supply valve 232 so that the washing water is supplied by the amount of cleaning water made by subtracting the amount of supply condensate water from the amount of spray cleaning water to be supplied to the cleaning nozzle 210 and sprayed.

Alternatively, the controller 270 can perform control to perform the cleaning process only by using the condensate water in the initial cleaning step, and when the water level of the condensate water stored in the condensate water storage tank 221 becomes equal to or lower than the predetermined water level, the controller 270 can perform control to open the washing water supply valve 232 to additionally supply the washing water.

Therefore, the controller 270 can perform control to use the washing water as the cleaning water when the amount of condensate water is insufficient, such that the sufficient amount of cleaning water can be sprayed to the condenser 143 and clean the condenser 143 cleanly.

Further, as illustrated in FIG. 3, the cleaner 200 can further include a washing drum discharge flow path 240 configured to connect the heat pump 140 and the washing drum 130 and discharge the cleaning water, which has cleaned the condenser 143, to the washing drum 130. That is, the cleaning water, which has cleaned the condenser 143, can be discharged to the washing drum 130 and used when the washing drum 130 performs the washing function, thereby saving water by reusing the water.

Further, the cleaner 200 can further include a discharge port discharge flow path 250 configured to connect the washing drum discharge flow path 240 and a discharge port 160 so that the cleaning water, which has cleaned the condenser 143, is discharged to the discharge port 160 that discharges the washing water, which is discharged from the washing drum 130, to the outside; and a cleaning water discharge valve 260 disposed between the washing drum discharge flow path 240 and the discharge port discharge flow path 250 and configured to open or close the discharge flow path. In some implementations, the controller 270 can control the cleaning water discharge valve 260 so that the cleaning water, which has cleaned the condenser 143, is discharged to any one of the washing drum 130 and the discharge port 160.

For example, when the washing water is supplied by the washing machine water supply unit 150 so that the washing drum 130 performs the washing function, the controller 270 opens the washing water supply valve 232 and supplies the washing water to the washing drum 130 and the cleaning nozzle 210. In some implementations, the controller 270 can control the cleaning water discharge valve 260 to open the washing drum discharge flow path 240, such that the cleaning water, which has cleaned the condenser 143, can be supplied to the washing drum 130 through the washing drum discharge flow path 240 and reused as the washing water for washing the laundry.

In some implementations, as illustrated in FIG. 2, the cleaner 200 can only include the discharge port discharge flow path 250 configured to connect the heat pump 140 and the discharge port 160 so that the cleaning water, which has cleaned the condenser 143, is discharged to the discharge port 160 that discharges the washing water, which is discharged from the washing drum 130, to the outside. That is, the cleaning water, which has cleaned the condenser 143, can be discharged directly to the discharge port 160 without being reused.

Hereinafter, a method for controlling the integrated washing-drying machine will be described with reference to the accompanying drawings.

Figure 5:
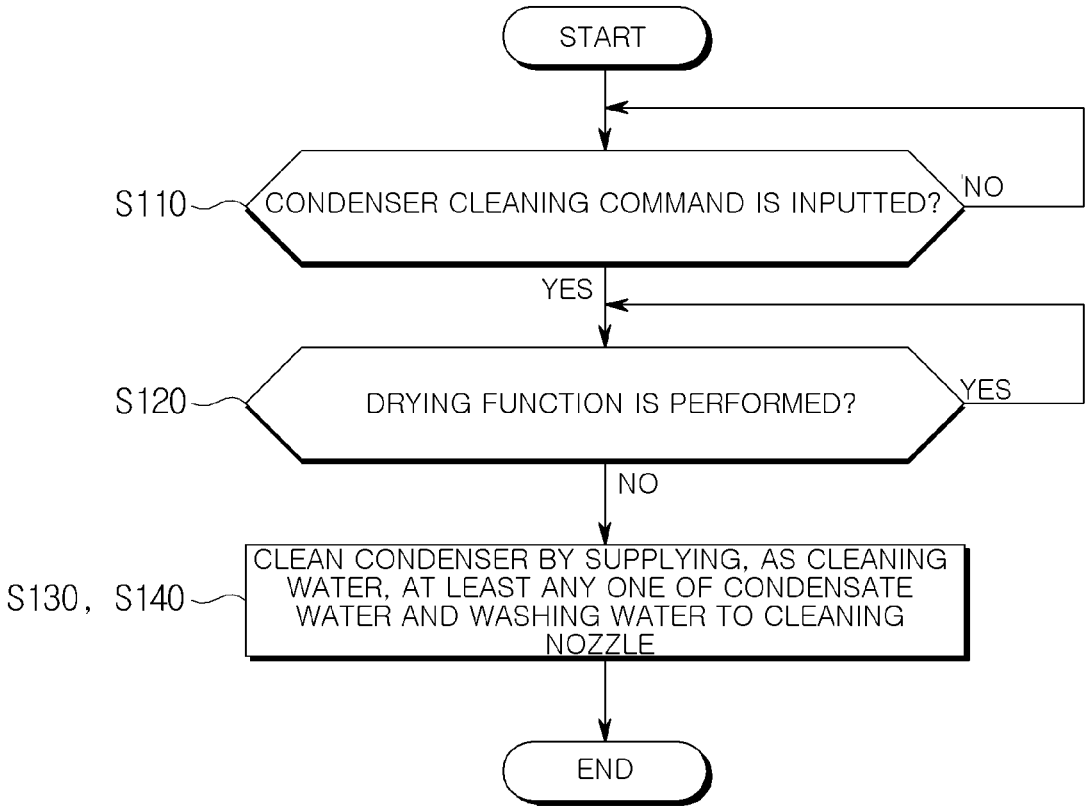
FIG. 5 is a flowchart schematically illustrating an example of a method for controlling the integrated washing-drying machine.
Figure 6:
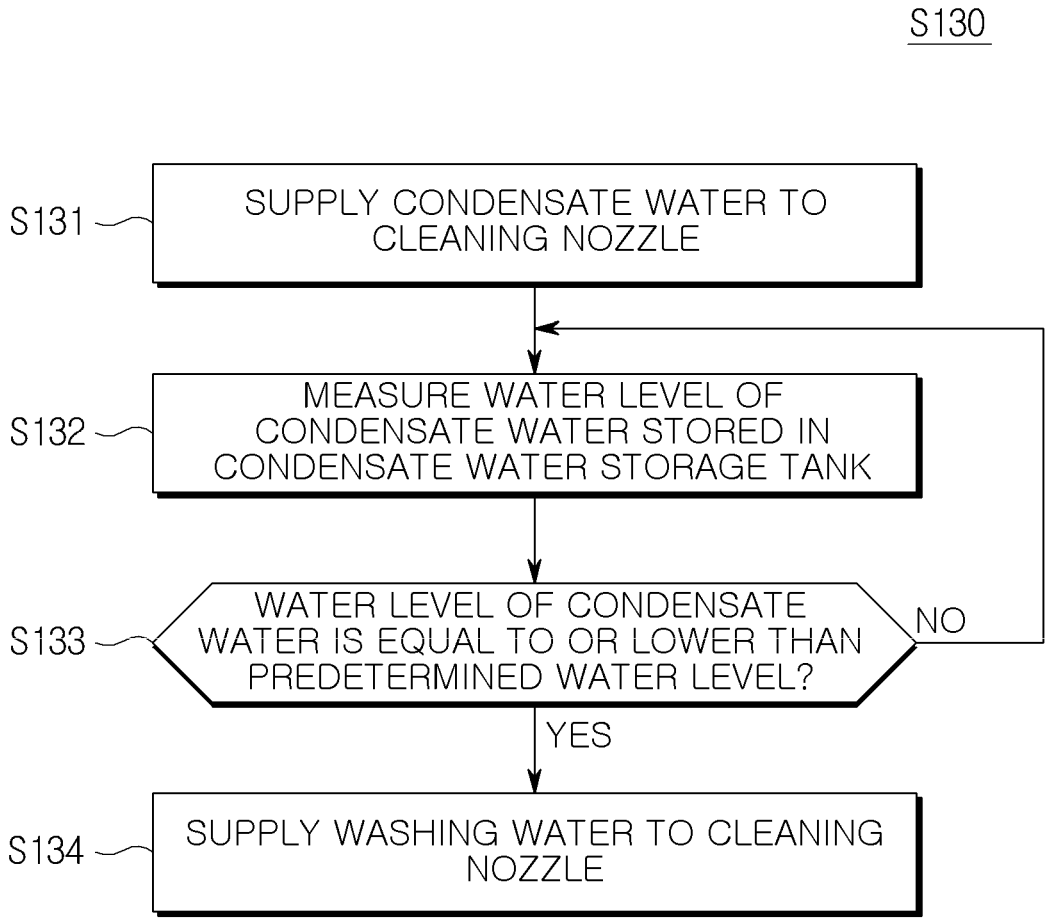
FIG. 6 is a flowchart schematically illustrating an example of a condenser cleaning step of the method for controlling the integrated washing-drying machine.
Figure 7:
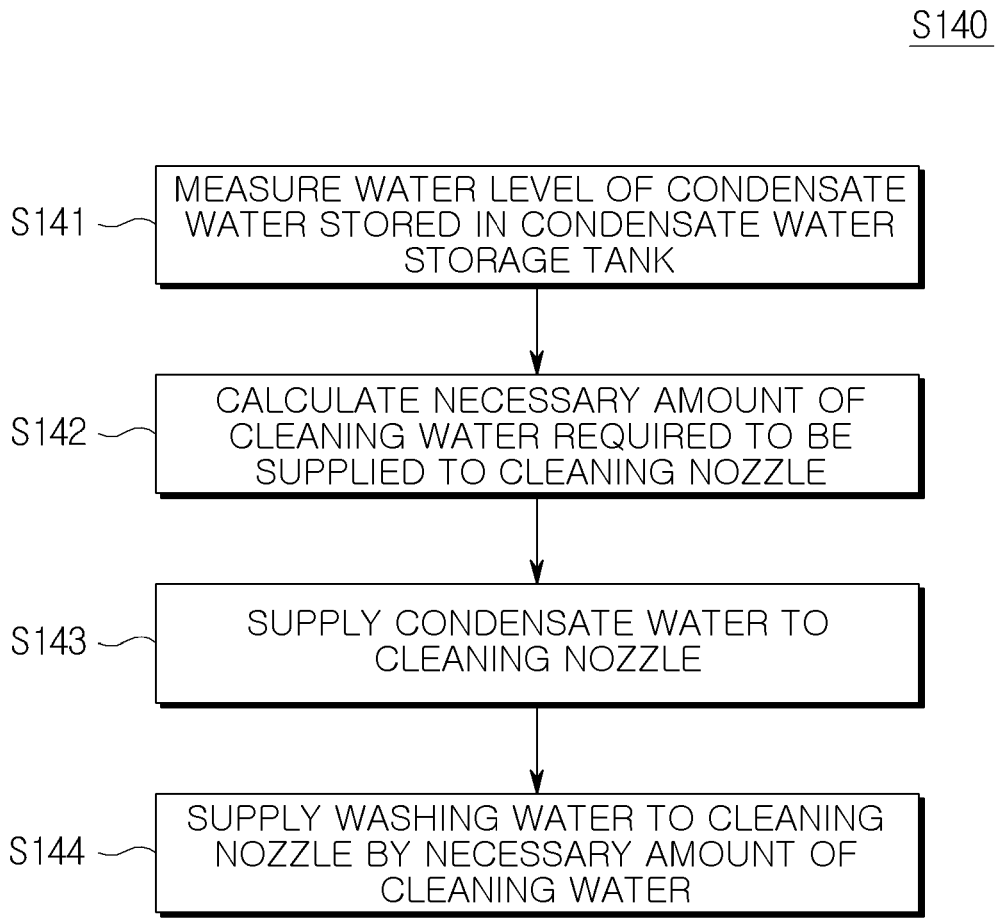
FIG. 7 is a flowchart schematically illustrating an example of the condenser cleaning step of the method for controlling the integrated washing-drying machine.
Figure 8:
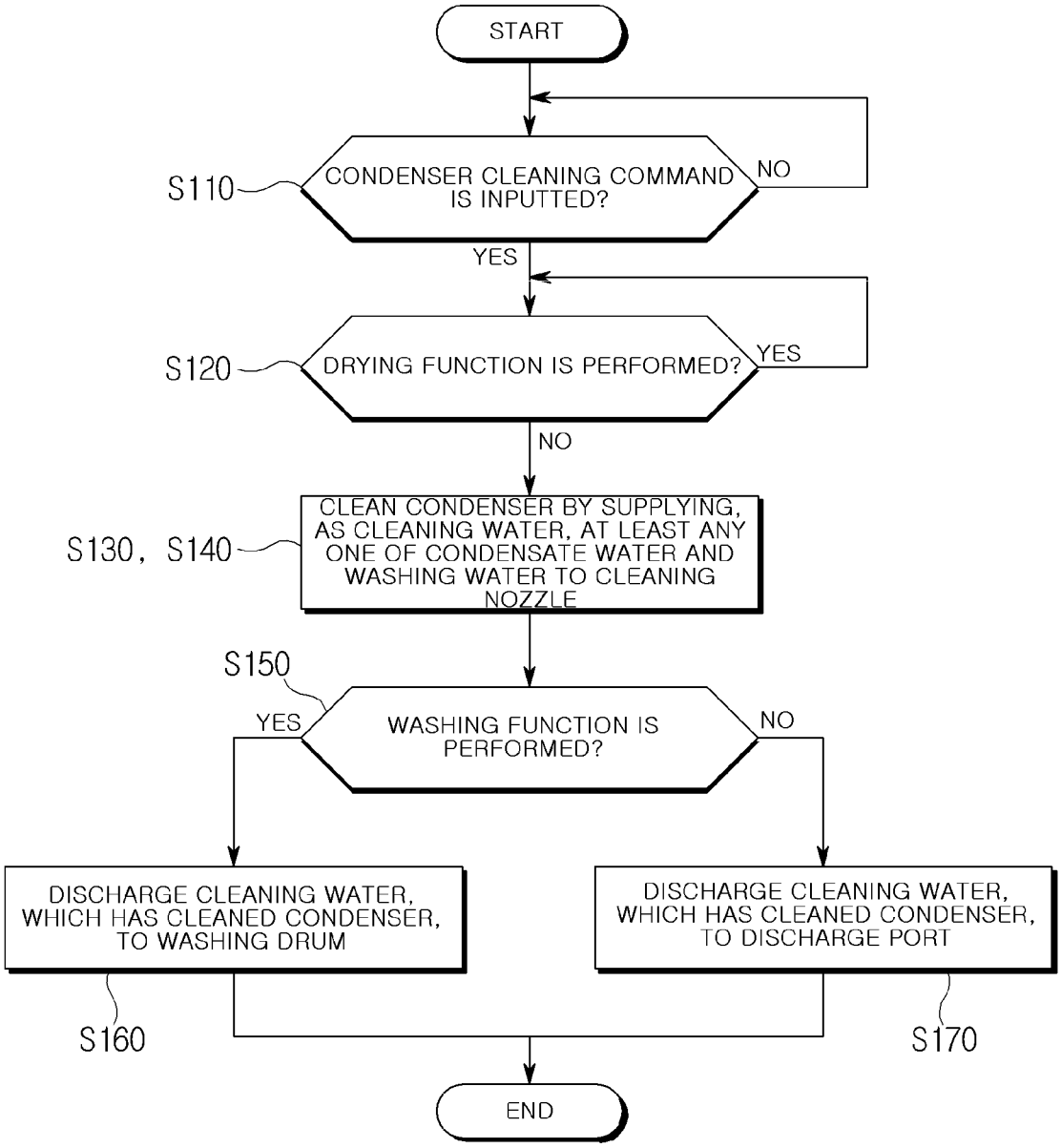
FIG. 8 is a flowchart schematically illustrating an example of a control method further including a cleaning water discharging step added to the method for controlling the integrated washing-drying machine.

FIG. 5 is a flowchart schematically illustrating an example of a method for controlling the integrated washing-drying machine, FIGS. 6 and 7 are flowcharts schematically illustrating examples of the condenser cleaning step of the method for controlling the integrated washing-drying machine, and FIG. 8 is a flowchart schematically illustrating an example of a control method further including a washing water discharging step added to the method for controlling the integrated washing-drying machine.

Referring to FIGS. 5 to 8, the method for controlling the integrated washing-drying machine relates to a method for controlling the integrated washing-drying machine, in which the drying drum is disposed at the upper side in the housing, the washing drum is disposed at the lower side in the housing, and the cleaning water sprayed from the cleaning nozzle cleans the condenser.

The method for controlling the integrated washing-drying machine includes: a cleaning command determining step S110 of determining whether a condenser cleaning command is inputted; a drying determining step S120 of determining whether the drying function is performed when the condenser cleaning command is inputted (YES in S110); and a condenser cleaning step S130 or S140 of cleaning the condenser by supplying, as the cleaning water to the cleaning nozzle, at least any one of the condensate water stored in the condensate water storage tank and the washing water to be supplied to the washing drum when the determination result indicates that the drying function is not performed (NO in S120).

In some implementations, the condenser cleaning command is created by any one or a combination of two or more of a user's operation input, an automatic input at a regular interval, an input before the drying function is performed, and an input after the drying function is completed.

More specifically, in the case of the user's operation input, an automatic condenser cleaning button is provided on an operation panel or a remote controller of the integrated washing-drying machine, and the user can forcibly clean the condenser by pushing the automatic condenser cleaning button.

Further, in the case of the automatic input at a regular interval, the condenser cleaning command is set to be inputted at regular intervals to the controller, and the condenser can be automatically cleaned as the condenser cleaning command is automatically inputted at regular set intervals.

Further, in the case of the input before the drying function is performed, when a drying function performing command is inputted to dry the laundry in the drying drum, the drying function can be performed after the condenser is cleaned as the condenser cleaning command is inputted immediately before the drying function is performed.

Further, in the case of the input after the drying function is completed, the condenser can be cleaned as the condenser cleaning command is inputted immediately after the laundry is completely dried in the drying drum.

Therefore, since all the methods of inputting the condenser cleaning commands can be set, or the condenser cleaning commands can be selectively inputted, thereby keeping the condenser clean.

The condenser cleaning step S130 or S140 is a step of cleaning the condenser by supplying, as the cleaning water to the cleaning nozzle, at least any one of the condensate water stored in the condensate water storage tank and the washing water to be supplied to the washing drum. In some implementations, the method can include one of the condenser cleaning step S130 or S140, or both. For example, the condenser cleaning steps S130 and S140 can be classified into the first condenser cleaning step S130, and the second condenser cleaning step S140.

More specifically, referring to FIG. 6, the first condenser cleaning step S130 includes a condensate water supplying step S131 of supplying the condensate water to the cleaning nozzle, a condensate water level measuring step S132 of measuring the water level of the condensate water stored in the condensate water storage tank, a washing water supplying step S134 of supplying the washing water to the cleaning nozzle when the determination result indicates that the water level of the condensate water is equal to or lower than the predetermined water level (YES in S133).

That is, in the first condenser cleaning step S130, the condensate water is primarily supplied to the cleaning nozzle first, and the washing water is additionally supplied when the water level of the condensate water stored in the condensate water storage tank becomes equal to or lower than the predetermined water level as the condensate water is supplied to the cleaning nozzle. In some implementations, the washing water is supplied together with the condensate water at the initial time when the condensate water is stored at the predetermined water level or lower before the condenser cleaning command is inputted.

Further, referring to FIG. 7, the second condenser cleaning step S140 includes a condensate water level measuring step S141 of measuring the water level of the condensate water stored in the condensate water storage tank, a supply cleaning water amount calculating step S142 of calculating the supply amount of cleaning water to be supplied to the cleaning nozzle in consideration of the amount of condensate water, a condensate water supplying step S143 of supplying the condensate water to the cleaning nozzle, and a washing water supplying step S144 of supplying the washing water to the cleaning nozzle by the supply amount of cleaning water.

In some implementations, in the supply cleaning water amount calculating step S142, the amount of supply condensate water, which can be supplied, is calculated based on the water level of the condensate water, and the supply amount of cleaning water is calculated by subtracting the amount of supply condensate water from the amount of spray cleaning water to be sprayed from the cleaning nozzle.

That is, the washing water is supplied as the additional cleaning water calculated by subtracting the amount of condensate water stored in the condensate water storage tank from the total amount of cleaning water to be supplied to the cleaning nozzle and used to clean the condenser. Therefore, the supply amount of cleaning water is calculated in advance, which makes it possible to minimize the use of washing water and save water.

Further, the method for controlling the integrated washing-drying machine according to the present disclosure further includes a washing determining step S150 of determining whether the washing function is performed, and a cleaning water discharging step S160 or S170 of discharging the cleaning water, which has cleaned the condenser, to any one of the washing drum and the discharge port that discharges the washing water, which is discharged from the washing drum, to the outside.

More specifically, in the cleaning water discharging step, the cleaning water, which has cleaned the condenser, is discharged to the washing drum and reused when the determination result indicates that the washing function is performed (YES in S150), thereby saving water.

Further, in the cleaning water discharging step, the cleaning water, which has cleaned the condenser, is discharged directly to the discharge port when the determination result indicates that the washing function is not performed (NO in S150). That is, if the cleaning water is discharged to the washing drum that does not perform the washing function, the water may remain in the washing drum, which can degrade cleanliness of the washing drum. Therefore, the cleaning water is discharged directly to the discharge port when the washing function is not performed.

In some implementations, the washing determining step S150 determines that the washing function is performed when the washing water is supplied to the washing drum among various steps for washing the laundry. That is, a step of supplying the washing water to the washing drum for washing the laundry and a step of supplying the washing water to the washing drum for rinsing the laundry are determined as a step of performing the washing function. In some examples, clean washing water can be supplied at the time of supplying the washing water for rinsing the laundry. Therefore, the step of supplying the washing water to the washing drum for washing the laundry can be determined as the step of performing the washing function.

Further, in the cleaning water discharging step, the cleaning water, which has initially cleaned the condenser, can be discharged to the discharge port for a predetermined period of time, and then the remaining cleaning water can be discharged to the washing drum when the determination result indicates that the washing function is performed (YES in S150).

That is, because the cleaning water, which has initially cleaned the condenser, contains a large amount of impurities, the cleaning water, which has initially cleaned the condenser, is discharged to the discharge port. After the condenser is cleaned to some extent, the cleaning water is comparatively clean. Therefore, when a predetermined time elapses after the condenser begins to be cleaned, the cleaning water can be discharged to the washing drum and reused.

Therefore, according to the method for controlling the integrated washing-drying machine according to the present disclosure, the condenser can be cleaned by using the cleaning water even though a small amount of condensate water is stored in the condensate water storage tank, which makes it possible to clean the condenser clean.

Further, the cleaning water, which has cleaned the condenser, can be discharged to the washing drum and reused at the time of washing the laundry, thereby saving water.

The present disclosure has been described with reference to the limited implementations and the drawings, but the present disclosure is not limited thereto. The described implementations can be changed or modified by those skilled in the art to which the present disclosure pertains within the technical spirit of the present disclosure and within the scope equivalent to the appended claims.

The invention claimed is:

1. A washing-drying machine comprising:

a housing;

a drying drum disposed in a first portion of the housing and configured to accommodate laundry to be dried;

a washing drum disposed in a second portion of the housing and configured to accommodate laundry to be washed;

a heat pump comprising an evaporator, a compressor, and a condenser, the heat pump being configured to produce hot air and to supply the hot air to the drying drum;

a cleaner configured to spray cleaning water to the condenser to thereby clean the condenser; and a washing machine water supply connected to an external water supply source and configured to supply washing water from the external water supply source to the washing drum and the cleaner, wherein the cleaner comprises:

a cleaning nozzle configured to spray the cleaning water to the condenser, a condensate water supply unit configured to supply condensate water generated in the evaporator to the cleaning nozzle, a washing water supply unit comprising (i) a washing water supply flow path that is branched from the washing machine water supply and connected to the cleaning nozzle and that is configured to supply the washing water to the cleaning nozzle, and (ii) a washing water supply valve configured to open and close the washing water supply flow path, and a controller configured to control the washing water supply valve to supply the washing water to at least one of the washing drum or the cleaning nozzle.

2. The washing-drying machine of claim 1, wherein the condensate water supply unit comprises:

a condensate water storage tank configured to store the condensate water condensed from the evaporator, and a pump configured to supply the condensate water stored in the condensate water storage tank to the cleaning nozzle, and wherein the controller is configured to control the pump and the washing water supply valve to thereby provide the cleaning water comprising at least one of the condensate water or the washing water to the cleaning nozzle.

3. The washing-drying machine of claim 2, wherein the cleaner further comprises a water level sensor configured to measure a water level of the condensate water stored in the condensate water storage tank, and wherein the controller is configured to receive data from the water level sensor and to open the washing water supply valve based on the water level of the condensate water being less than or equal to a predetermined water level.

4. The washing-drying machine of claim 3, wherein the controller is configured to:

determine a supply amount of the condensate water stored in the condensate water storage tank and available to be supplied to the cleaner based on the water level of the condensate water in the condensate water storage tank;

determine a supply amount of the washing water based on subtracting the supply amount of the condensate water from a target amount of the cleaning water to be supplied to the cleaning nozzle; and adjust an opening degree of the washing water supply valve to supply the supply amount of the washing water.

5. The washing-drying machine of claim 2, wherein the cleaner further comprises a washing drum discharge flow path that connects the heat pump to the washing drum and is configured to guide, to the washing drum, the cleaning water having been used to clean the condenser.

6. The washing-drying machine of claim 5, further comprising:

a discharge port connected to the washing drum and configured to discharge the washing water from the washing drum to an outside of the housing, wherein the cleaner further comprises:

a discharge port discharge flow path that connects the washing drum discharge flow path to the discharge port and is configured to guide, to the discharge port, the cleaning water having been used to clean the condenser; and a cleaning water discharge valve disposed between the washing drum discharge flow path and the discharge port discharge flow path and configured to open and close each of the washing drum discharge flow path and the discharge port discharge flow path, and wherein the controller is configured to control the cleaning water discharge valve to discharge, to the washing drum or the discharge port, the cleaning water having been used to clean the condenser.

7. The washing-drying machine of claim 1, further comprising:

a discharge port connected to the washing drum and configured to discharge the washing water from the washing drum to an outside of the housing, wherein the cleaner further comprises a discharge port discharge flow path that connects the heat pump to the discharge port and is configured to guide, to the discharge port, the cleaning water having been used to clean the condenser.

8. The washing-drying machine of claim 1, wherein the controller is configured to:

determine whether a condenser cleaning command is inputted;

based on the condenser cleaning command being inputted, determine whether a drying function of the drying drum is performed; and based on determining that the drying function is not performed, clean the condenser by supplying the cleaning water to the cleaning nozzle.

9. The washing-drying machine of claim 1, wherein the first portion of the housing is an upper space in the housing, and the second portion of the housing is a lower space in the housing.

10. The washing-drying machine of claim 1, wherein the condenser is disposed in the second portion of the housing, and the cleaner is disposed between the drying drum and the condenser.

* * * * *